US006997086B1

(12) United States Patent
Graham

(10) Patent No.: US 6,997,086 B1
(45) Date of Patent: Feb. 14, 2006

(54) LOCKING SCREWDRIVER

(76) Inventor: Neil John Graham, 6017 Lido La., Long Beach, CA (US) 90803

( * ) Notice: Subject to any disclaimer, the term of this patent is extended or adjusted under 35 U.S.C. 154(b) by 0 days.

(21) Appl. No.: 11/217,715

(22) Filed: Sep. 2, 2005

(51) Int. Cl.
*B25B 23/10* (2006.01)

(52) U.S. Cl. ..... 81/451; 81/456

(58) Field of Classification Search ..... 81/451–453, 81/456, 53.2
See application file for complete search history.

(56) References Cited

U.S. PATENT DOCUMENTS

| | | | | | |
|---|---|---|---|---|---|
| 2,399,138 | A | * | 4/1946 | Nygaard | 81/452 |
| 2,406,952 | A | * | 9/1946 | Josepho | 81/452 |
| 2,576,742 | A | * | 11/1951 | Wolny | 81/453 |
| 3,735,650 | A | | 5/1973 | Weng, Jr. | |
| 3,901,298 | A | * | 8/1975 | Eby | 81/455 |
| 4,204,308 | A | | 5/1980 | Marling | |
| 4,339,971 | A | | 7/1982 | Zatorre | |
| 4,389,913 | A | | 6/1983 | Drouin | |
| 4,507,837 | A | | 4/1985 | Hinkle | |
| 5,056,387 | A | * | 10/1991 | Cook | 81/456 |
| 6,082,233 | A | * | 7/2000 | Han | 81/453 |
| 6,128,982 | A | * | 10/2000 | Gwin, Sr. | 81/452 |
| 6,244,141 | B1 | * | 6/2001 | Han | 81/453 |
| 6,267,025 | B1 | | 7/2001 | Sand | |
| 6,701,812 | B1 | * | 3/2004 | Sawamura | 81/453 |
| 6,857,343 | B1 | * | 2/2005 | Easterbrooks et al. | 81/452 |

* cited by examiner

*Primary Examiner*—David B. Thomas
(74) *Attorney, Agent, or Firm*—Neil John Graham

(57) ABSTRACT

A locking screwdriver which engages and locks to the head of a screw preventing unseating of the screwdriver from the screw during screw removal and firmly holding and guiding self-tapping screws during their placement.

21 Claims, 5 Drawing Sheets

1
2
3
4
10
11
12
20
21
22
23
24
25
26
30
31
32
33
40
42
43
44
45
50
51
60

70
71
12
19
13
10

20

25
26
2
16
16
31
30
32
40

50A
50
52A
50
51
50
53
50B 26
26B
26A 28A
25
27

31
28A
28B
32
28C 17
42
44
2
48
41
42
43
44
45
17

18
19
13
16
10
17
50A
52
50
50B
51
18

LOCKING SCREWDRIVER

FIELD OF THE INVENTION

The present invention is directed to a screwdriver which locks to a screw preventing the screwdriver from unseating from the screw during the initial placement and removal of the screw.

BACKGROUND OF THE INVENTION

A variety of instruments have been developed to remove screws where the head of the screw has been damaged. The head of the screw is most frequently damaged by the screwdriver during the attempt to remove the screw. Considerable steady pressure must be placed on the screwdriver to keep the screwdriver seated on the head of the screwdriver. If the screwdriver head is allowed to lift from the head of the screw the screw will be stripped. The screw will then have to be removed by other means. This damage is more common with a Phillips screwdriver head. Although a number of tools have been developed to remove damaged screws, none have been developed to prevent the screwdriver damage in the first place. A need exists for a simple, easy to use tool which enables the removal of a hard to remove screw without damaging the head of the screw. The tool must firmly hold the head of the screw and not allow any lifting of the screwdriver head away from the screw during the screw removal process. Additionally tools have also been developed for the placement of screws. A common tool grips the screw head holding the screw to the head of the screwdriver. A similar screwdriver is magnetic which would hold a magnetic screw; but, is not useful for a non-magnetic screw. These screwdrivers are useful for placing a hard to hold screw in a pre-threaded or pre-drilled screw hole. In the case of self tapping and wood type screws they don't hold the screw firmly enough to allow the screw to start its own hole and be directionally guided during its placement, an added step of drilling or punching a guide hole is required which is especially time consuming and cumbersome when using surgical screws.

BRIEF SUMMARY OF THE INVENTION

The present invention is directed to a locking screwdriver for holding a screw during the placement and removal of a screw. The invention firmly locks the screwdriver tip against a screw which aids in the placement of the screw and prevents the screwdriver from unseating and damaging the screw head during the removal of the screw. The locking screwdriver is comprised of a longitudinal tube with a circumferentially externally grooved first end and a second end externally threaded, the second end has attached locking fingers extending longitudinally; a longitudinal rod with an externally threaded first end, a male fitting projecting longitudinally from the first end with an attached handle, a second rod end with a female fitting containing a male fitting extending longitudinally ending in a screwdriver fitting means; two internally threaded collets, the first collet is rotatably attached to the circumferential groove of the first end of the tube and threaded to the first rod end, the second collet is threaded to the second end of the rod and surrounds the locking fingers.

The locking screwdriver is used by placing the gripping fingers around the screw head, locking the fingers to the screw head by turning the second collet clockwise and rotating the first collet clockwise which seats the screwdriver tip means to the screw, the handle is turned clockwise to place a screw and counterclockwise to remove a screw.

In an alternative embodiment the locking screwdriver can be fitted with cutting tips at the end out of the gripping arms to remove material from around a sunken screw. In an alternative embodiment the internal of the locking fingers can have notches for more securely gripping the screw head. Additionally in other embodiments the handle can be placed with a ratchet wrench which applies more force, useful during the removal of a frozen screw. The screwdriver fittings can be for machine screws, self-tapping, flat head and lag screws.

The screwdriver locking tool is useful in firmly holding a screw, especially a wood screw, during the screw's initial placement. The screw would placed by locking the screw in the tool, placing the tip of the screw on the surface of the material, tapping the end of the tool handle with a hammer.

DETAILED DESCRIPTION OF THE INVENTION

Figure 3:
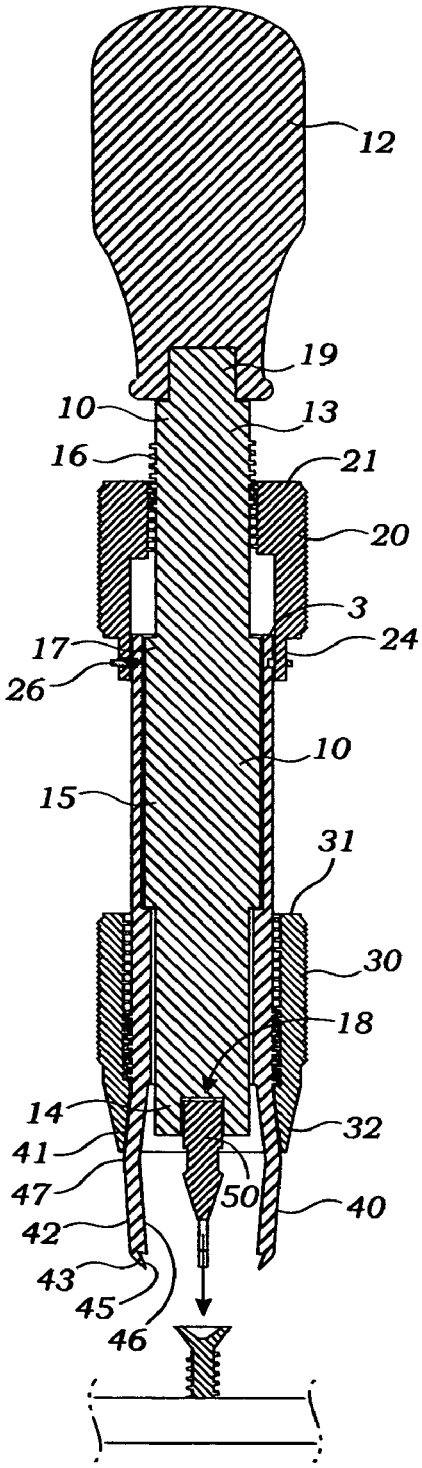
FIG. 3 is a cross sectional view taken along the lines of 3—3 of FIG. 1.
Figure 4:
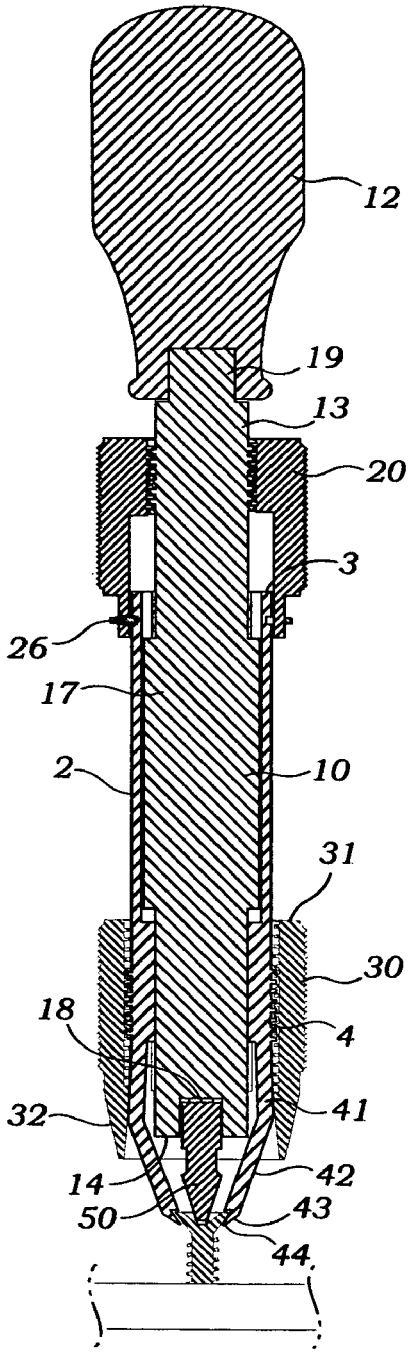
FIG. 4 is a cross sectional view taken along the lines of 4—4 of FIG. 1.
Figures 5, 6, 7, 8, 9, 10:
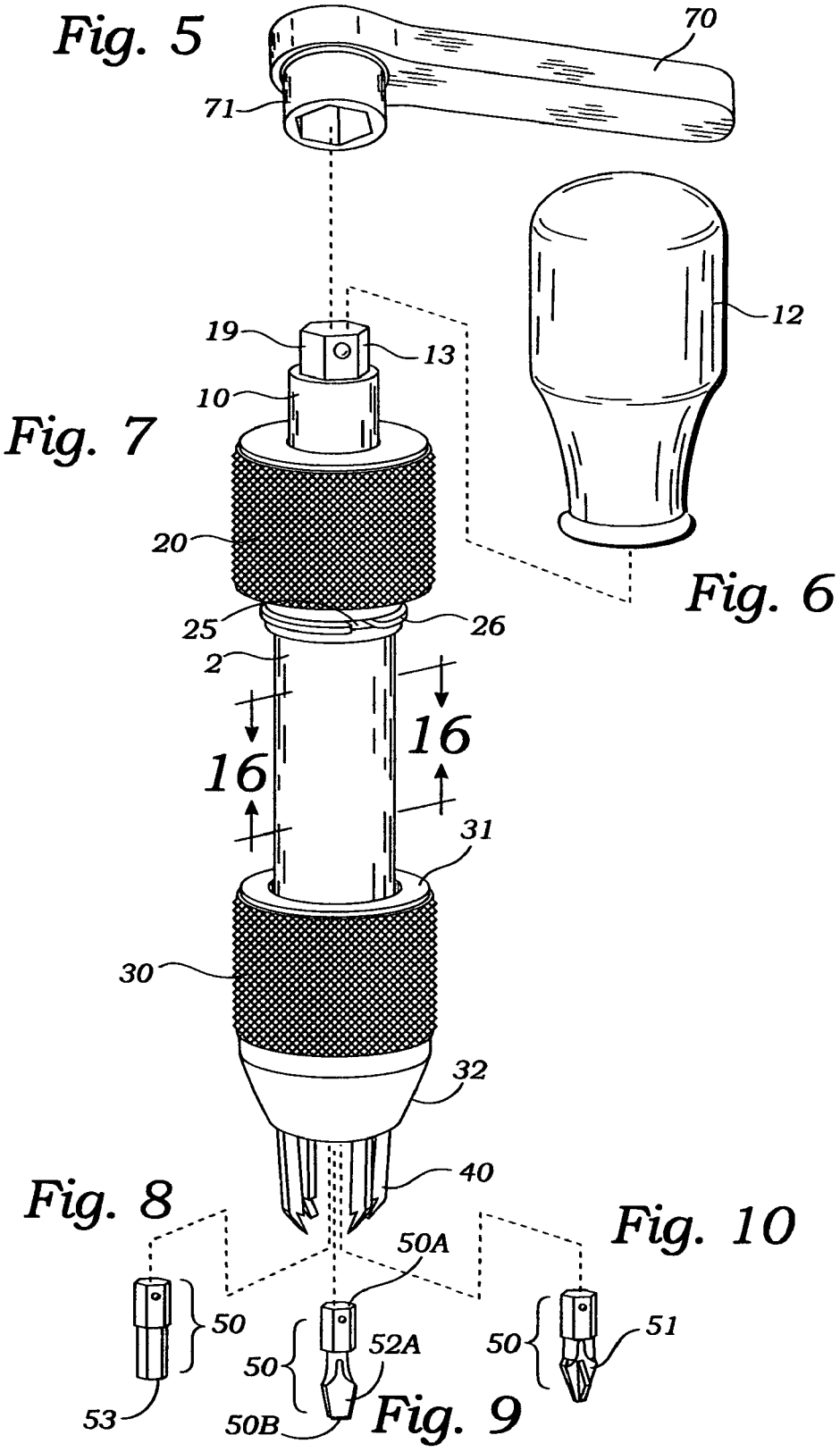
FIG. 5 is a perspective view of a ratchet wrench handle.
FIG. 6 is a perspective view of a screwdriver handle.
FIG. 7 is a perspective view of the locking screwdriver.
FIG. 8 is a perspective view of a locking screwdriver end fitting.
FIG. 9 is a perspective view of a locking screwdriver end fitting.
FIG. 10 is a perspective view of a locking screwdriver end fitting.
Figure 16:
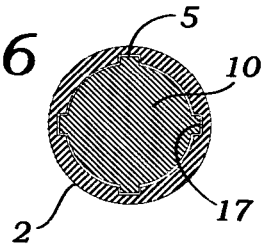
FIG. 16 is a cross sectional view taken along the lines of 16—16 of FIG. 7.
Figure 17:
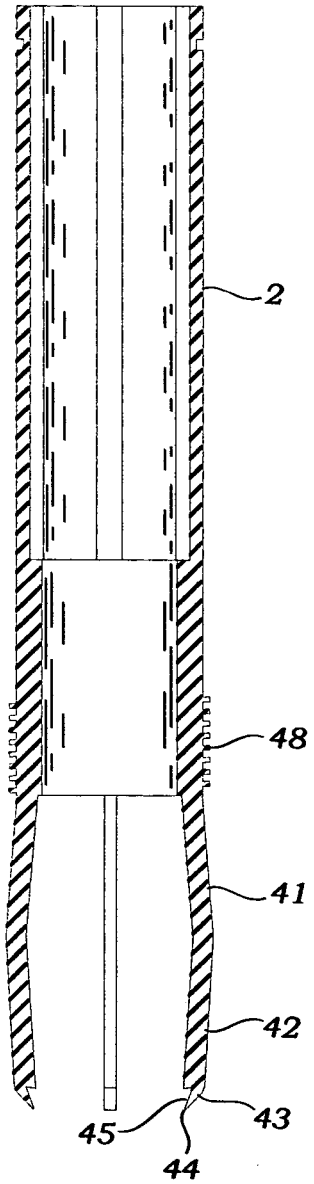
FIG. 17 is a cross sectional view taken along the lines of 17—17 of FIG. 14.
Figure 18:
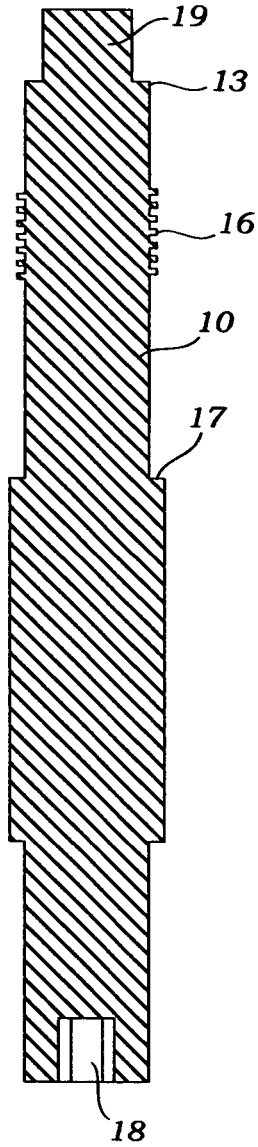
FIG. 18 is a cross sectional view taken along the lines of 18—18 of FIG. 15.

Referring to FIGS. 1,2,3,4 and 5 the locking screwdriver 1 has a longitudinal tube 2 which contains an internal longitudinal rod 10 which moves longitudinally within the longitudinal tube 2 guided by longitudinal rod ridges 17, FIGS. 3, 4, 15 and 16, which slide within longitudinal slots 5, FIG. 16, of the longitudinal tube 2. The slot 5 and ridge 17 combinations assures the locking screwdriver 1 rotates as a unit. The longitudinal rod 10, as shown in FIGS. 1, 2, 3, 4, 7, 15 and 18, has a first end 13 with a longitudinal extension comprising a male hexagonal fitting 19 for the attachment of a screwdriver handle 12. The longitudinal rod 10 near the first rod end 13 has circumferential threads 16, FIGS. 15 and 18, which extend outwardly from the rod external surface 11 as shown in FIGS. 3, 4, 15 and 18. The longitudinal rod 10 has a second end with a female hexagonal socket 18 for receiving the male fitting 52 of the first end 50A of the screwdriver end means 50 as shown in FIGS. 1, 2, 3, 4, 7, 9, 10 and 18. The screwdriver end means 50 has a second end SOB with a screwdriver fitting means 50B as shown in FIGS. 1, 2, 3, 4, 7, 8, 10 and 15. As shown in FIGS. 1, 2, 3, 4, 7, 14 and 17 the longitudinal tube 2 has first 3 and second 4 ends, the first end 3 has an external circumferential slot 42, as shown in FIG. 14, the second end 4 has external circumferential threads 48 and longitudinal extensions forming a plurality of gripping fingers 40 as in FIGS. 1, 2, 3, 4, 7, and 14. The gripping fingers 40 form a discontinuous annulus wherein the fingers 42 have internal 46 and outer 47 surfaces and first 41 and second 42 sections as shown in FIGS. 3, 4 and 14. The first finger sections 41 gently taper outwards and continue in second finger sections 41 which gently curve inwards. The internal surfaces 46 of the gripping fingers 40 are curved to approximately fit the head of a screw 60 as shown in FIGS. 1,2,3,4, 7, 12, 13, 14 and 15. In FIGS. 1, 2, 3, 4 and 7 first 20 and second 30 collets are attached to the longitudinal tube 2, the first collet 20 is attached to the longitudinal tube 2 first end 3 using a locking C clasp 26 which is placed in an external circumferential slot 25 which is in a narrowed portion 24 of the second end 22 of the first collet 20. The C clasp 26, as in FIG. 11, has internal projections 26A which are directed to the axial center 26B of the C clasp 26 and are fitted through the respective openings 27 in the external circumferential slot 25 and into the interior 28 of the first collet 20. The C clasp projections 26 lock into the circumferential slot 42 of the longitudinal tube 2 which connects rotatably connects the longitudinal tube 20 to the first collet 20.

Figures 11, 12, 13, 14, 15:
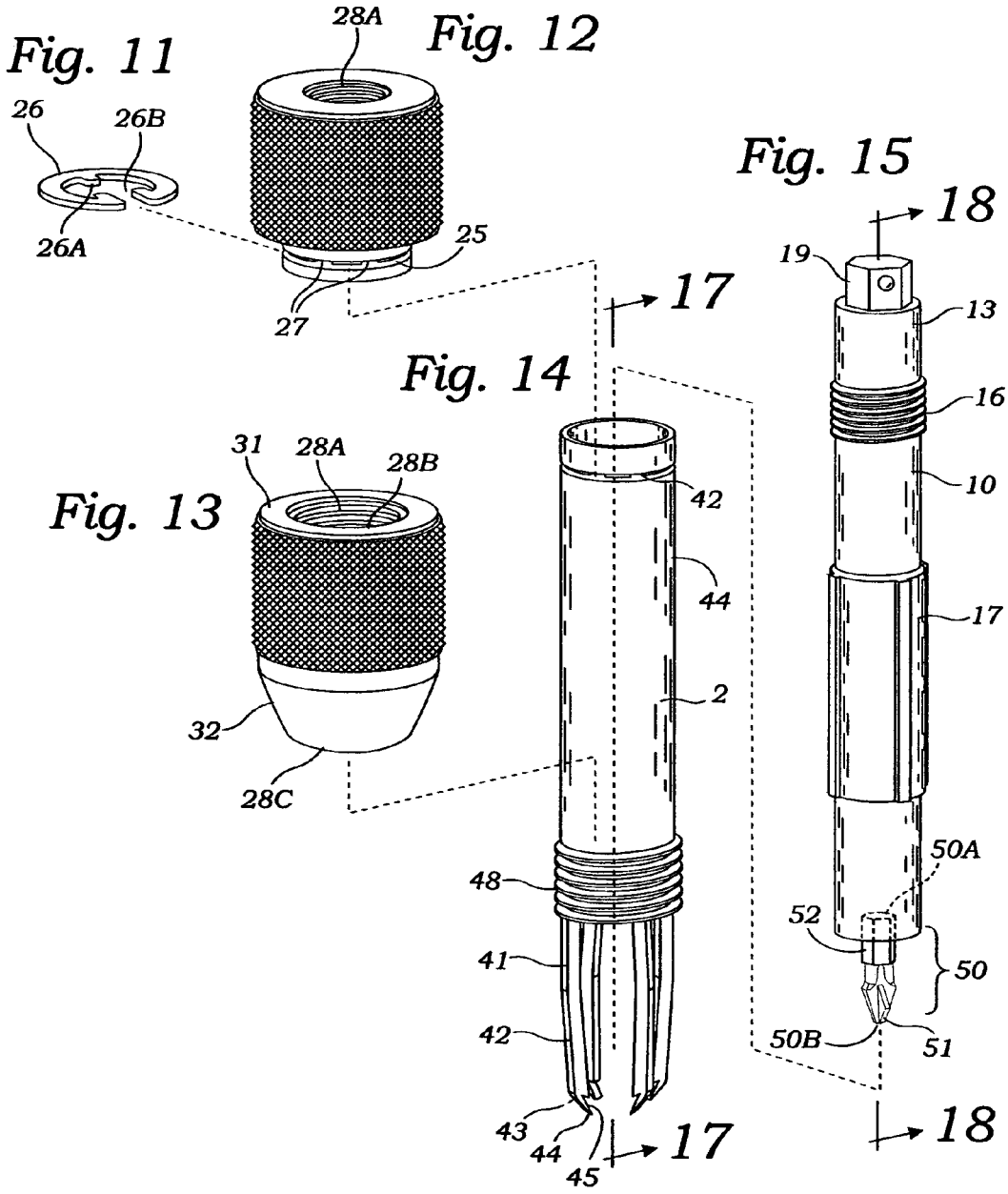
FIG. 11 is a perspective view of a C clasp.
FIG. 12 is a perspective view of the first collet.
FIG. 13 is a perspective view of the second collet.
FIG. 14 is a perspective view of the longitudinal tube.
FIG. 15 is a perspective view of the longitudinal rod.

The first collet 20 has a threaded 28A interior 28, FIG. 11, which is screwed to the first end threads 19A of the longitudinal rod 10. FIGS. 3 and 4. When the first collet 20 is turned clockwise the longitudinal rod 10 is moved towards the second longitudinal tube end 4 which seats the screwdriver end means 50 in the head of the screw 60, FIGS. 1, 2, 3 and 4. The second collet 30, in FIGS. 1, 2, 3, 4, 7 and 13, has a first end 31 threaded 28A interior 28B and a second end 32 interior 28C which is tapered inwards towards the second collet end 32. As the second collet 30 is turned clockwise the second collet 30 interior closes the gripping fingers 40 axially inwards wherein the gripping fingers 40 grip the head 60 of the screw FIGS. 2 and 4.

Figures 1, 2:
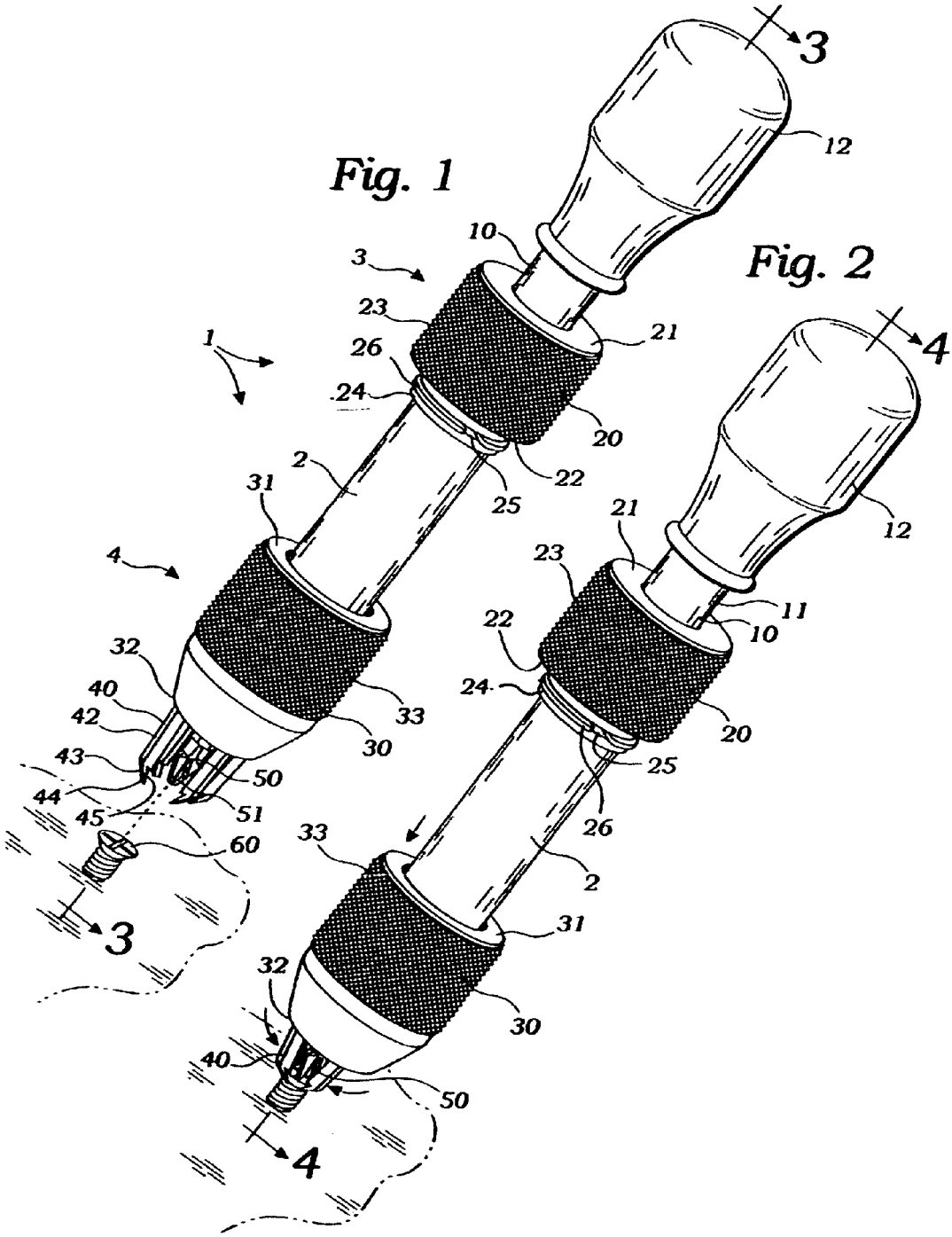
FIG. 1 is a perspective view of the locking screwdriver.
FIG. 2 is a perspective view of the locking screwdriver.

The method of locking screwdriver end means 50 to the screw head 60 is to place a screwdriver end means 50 in the screwdriver screw head 60, FIG. 2, and turn the first collet 20 until the gripping fingers 40 are adjacent to the screw head 60 and then turn the second collet 30 clockwise until the gripping fingers 40 grip. In a variety of embodiments the screwdriver end means 50 may be a hexagonal male fitting 53, FIG. 8, a flat blade end 52A, FIG. 9, and a Phillips screwdriver 51, FIG. 10. In a further embodiment the screwdriver means 50 is magnetic which will hold an iron-based screw 60 to the screwdriver end means 50, which is particularly useful during screw placement. In another embodiment, in FIGS. 1, 2, 7, 12 and 13, the exterior surfaces 23 of the first collet 20 and exterior surface 33 of the second collet 30 may be grooved in a cross-cut manner enhancing gripping of the collets 20 and 30.

In another embodiment, in FIGS. 1, 2, 3, 4,7, 14 and 17, the gripping fingers 40 have a third section 43 extending longitudinally from the second end 42. The third section 43 turns abruptly axially inwards and ends in cutting tips which are used for removing material around the head of an In embedded screw 60. In another embodiment in FIGS. 1, 2, 3, 4, 7, 14, and 17, each gripping fingers 40 internal surface 46 has a notch 45 where the second finger section 42 meets the third finger section 43. The notch 45 enhances the gripping of the head of the screw 60. In another embodiment the handle means is a ratchet wrench 70, as shown in FIG. 5, which is advantageous for moving hard to remove screws and placing screws in hard material. The locking screwdriver 1 is particularly useful in placing surgical screws in bones; the tool maintains the direction of the screw during the placement, thus eliminating the need for drilling a guide hole. A particular example is where screw are placed between adjacent roots of teeth, the screw can be placed without drilling a guide hole, the drilling of a guide hole runs the risk of damaging the roots of the teeth.

The invention is described with specific embodiments. However, the intent of the invention is to provide locking screwdriver that will remove a hard to remove screw without damaging the screw head and to firmly hold screws in place during their placement. The object is to hold the screwdriver so firmly against the screw head the screwdriver will not unseat and damage the screw head.

What is claimed is:

1. A locking screwdriver for placing and removing screws comprising:

a longitudinal axial tube with a first end, second end, a circumference, an external, an internal and multiple internal longitudinal grooves, the first end has an external circumferential slot;

a locking C-clasp with an axial center and multiple projections which extend towards the axial center;

a plurality of gripping fingers longitudinally extending from the longitudinal axial tube second end wherein the gripping fingers form a discontinuous annulus which surrounds the head of a screw, the gripping fingers have two sections, first and second ends and inner and outer surfaces, the gripping fingers first ends are attached to the longitudinal axial tube second end, the outer finger surfaces taper outwardly forming the first section as they extend longitudinally from the longitudinal axial tube second end, the gripping fingers extend longitudinally and form the second sections which outer surfaces taper axially inwards, the inner surfaces of the gripping fingers are curved to approximately match the external curvature of the head of the screw;

a circular longitudinal rod with a first end, middle, second end, an external circumference surface, external surface threads, plurality of longitudinal ridges, a male socket fitting and a female fitting wherein the external surface threads are adjacent to the longitudinal axial tube first end, the threads extend outwards from the external circumference surface of the circular longitudinal rod, the plurality of longitudinal ridges extend longitudinally from the middle of the circular longitudinal rod external surface towards the circular longitudinal rod second end, the circular longitudinal rod first end contains the male socket projecting longitudinally, the male socket fitting for a rotational force means, and the female fitting is within the circular longitudinal rod second end wherein the circular longitudinal rod ridges are fitted within the longitudinal grooves of the longitudinal axial tube which allow the longitudinal rod, when placed within the longitudinal tube with the respective first and second ends matching, to slide longitudinally within the longitudinal axial tube, but not rotate within the longitudinal axial tube;

a first collet with a first end, a second end, an exterior, and an interior wherein the interior is threaded to fit the longitudinal rod threads, the second end is circumferentially narrowed and contains a circumferential slot wherein the C-clasp with multiple inward projections is attached, the circumferential slot contains multiple holes to receive the three inner projections of the C-clasp, the first collet is attached to the circumferential slot of the longitudinal circular tube with the C-clasp inner projections engaging the external circumferential slot of the circular longitudinal tube, allowing the first collet to freely axially rotate on the circular longitudinal rod, when the longitudinal rod is placed within the longitudinal tube with their respective first and second ends matching and the second collet internal threads engage the longitudinal rod external threads the longitudinal rod is advanced towards the longitudinal tube second end when the first collet is axially rotated clockwise;

a second collet with an interior, an exterior, a first end and a second end, the first end interior is threaded to fit the external threads of the longitudinal axial tube and the second end second collet interior is tapered which engages the external of the gripping fingers and moves the gripping fingers axially inwards until the gripping fingers interiors grip the head of the screw when the second collet is screwed clockwise towards the plurality of gripping fingers; and a screwdriver end means with a first and second end, the first end has a male socket fitting which is inserted into the female fitting of the circular longitudinal rod, the second end has a screw head fitting means wherein the screw is placed between the plurality of gripping fingers and the first collet is rotated clockwise until the internal surfaces of the gripping fingers grip the head of the screw, the second collet is rotated clockwise until the second end of the screwdriver end means engages the head of the screw firmly which prevents damage to the screw head by the screwdriver during placing and removal of the screw.

2. The locking screwdriver as in claim 1 wherein third portions of the gripping fingers extend longitudinally outwards from the second portions of the gripping fingers, the third portions with externals and internals turn abruptly axially inwards and end in pointed cutting tips, the pointed tips are used to remove material around the head of a sunken screw.

3. The locking screwdriver as in claim 2 wherein an internal notch is formed where the internal of the second portions of the gripping fingers meet the internals of the third portions of gripping fingers wherein the internal notches grip the head of a screw.

4. The locking screwdriver as in claim 1 wherein the screwdriver means is a Phillips screwdriver.

5. The locking screwdriver as in claim 1 wherein the screwdriver means is a regular flat blade driver.

6. The locking screwdriver as in claim 1 wherein the screwdriver means is a Hex male driver.

7. The locking screwdriver as in claim 1 wherein the screwdriver means is magnetic for holding a screw in place during the locking of the screw head to the locking screwdriver.

8. The locking screwdriver as in claim 1 wherein the first and second collets have external surfaces that are crosscut in order to increase hand gripping of the collets.

9. The locking screwdriver as in claim 1 wherein a screwdriver handle with a female socket is attached to the male socket of the first rod end.

10. The locking screwdriver as in claim 1 wherein a ratchet wrench is attached to the male socket of the first circular longitudinal rod end.

11. A locking screwdriver for placing and removing screws comprising:

a longitudinal axial tube with a first end, second end, a circumference, an external, an internal and multiple internal longitudinal grooves, the first end has an external circumferential slot;

a locking C-clasp with an axial center and multiple projections which extend towards the axial center;

a plurality of gripping fingers longitudinally extending from the longitudinal axial tube second end wherein the gripping fingers form a discontinuous annulus which surrounds the head of a screw, the gripping fingers have two sections, first and second ends and inner and outer surfaces, the gripping fingers first ends are attached to the longitudinal axial tube second end, the outer finger surfaces taper outwardly forming the first section as they extend longitudinally from the longitudinal axial tube second end, the gripping fingers extend longitudinally and form the second sections which outer surfaces taper axially inwards, the inner surfaces of the gripping fingers are curved to approximately match the external curvature of the head of the screw;

a circular longitudinal rod with a first end, middle, second end, an external circumference surface, external surface threads, plurality of longitudinal ridges, a male socket fitting and a female fitting wherein the external surface threads are adjacent to the longitudinal axial tube first end, the threads extend outwards from the external circumference surface of the circular longitudinal rod, the plurality of longitudinal ridges extend longitudinally from the middle of the circular longitudinal rod external surface towards the circular longitudinal rod second end, the circular longitudinal rod first end contains the male socket projecting longitudinally, the male socket fitting for a rotational force means, and the female fitting is within the circular longitudinal rod second end wherein the circular longitudinal rod ridges are fitted within the longitudinal grooves of the longitudinal axial tube which allow the longitudinal rod, when placed within the longitudinal tube with the respective first and second ends matching, to slide longitudinally within the longitudinal axial tube, but not rotate within the longitudinal axial tube;

a first collet with a first end, a second end, an exterior, and an interior wherein the interior is threaded to fit the longitudinal rod threads, the second end is circumferentially narrowed and contains a circumferential slot wherein the C-clasp with multiple inward projections is attached, the circumferential slot contains multiple holes to receive the three inner projections of the C-clasp, the first collet is attached to the circumferential slot of the longitudinal circular tube with the C-clasp inner projections engaging the external circumferential slot of the circular longitudinal tube, allowing the first collet to freely axially rotate on the circular longitudinal rod, when the longitudinal rod is placed within the longitudinal tube with their respective first and second ends matching and the second collet internal threads engage the longitudinal rod external threads the longitudinal rod is advanced towards the longitudinal tube second end when the first collet is axially rotated clockwise;

a second collet with an interior, an exterior, a first end and a second end, the first end interior is threaded to fit the external threads of the longitudinal axial tube and the second end second collet interior is tapered which engages the external of the gripping fingers and moves the gripping fingers axially inwards until the gripping fingers interiors grip the head of a screw when the second collet is screwed clockwise towards the plurality of gripping fingers;

a screwdriver end means with a first and second end, the first end has a male socket fitting which is inserted into the female fitting of the circular longitudinal rod, the second end has a screw head fitting means wherein the screw is placed between the plurality of gripping fingers and the first collet is rotated clockwise until the internal surfaces of the gripping fingers grip the head of the screw, the second collet is rotated clockwise until the second end of the screwdriver end means engages the head of the screw firmly which prevents damage to the screw head by the screwdriver during placing and removal of the screw;

third portions of the gripping fingers which extend longitudinally outwards from the second portions of the gripping fingers, the third portions with externals and internals turn abruptly axially inwards and end in pointed cutting tips, the pointed tips are used to remove material around the head of a sunken screw; and internal notches each formed where the internal of the second portions of the gripping fingers meet the internals of the third portions of gripping fingers wherein the internal notches grip the head of the screw.

12. The locking screwdriver as in claim 1 wherein the screwdriver means is a Phillips screwdriver.

13. The locking screwdriver as in claim 1 wherein the screwdriver means is a regular flat blade driver.

14. The locking screwdriver as in claim 1 wherein the screwdriver means is a Hex male driver.

15. The locking screwdriver as in claim 1 wherein the screwdriver means is magnetic for holding a screw in place during the locking of the screw head to the locking screwdriver.

16. The locking screwdriver as in claim 1 wherein the first and second collets have external surfaces are crosscut in order to increase hand gripping of the collets.

17. The locking screwdriver as in claim 1 wherein a screwdriver handle with a female socket is attached to the male socket of the first rod end.

18. The locking screwdriver as in claim 1 wherein a ratchet wrench is attached to the male socket of the first circular longitudinal rod end.

19. A method for using a locking screwdriver, the locking screwdriver being comprised of a longitudinal tube with internal slots, a locking C-clasp, a longitudinal rod with external ridges, gripping fingers, a first collet, a second collet, cutting blades, a handle means and a screwdriver fitting means, the method of use of the locking screwdriver comprises:

placing the gripping fingers around the head of screw;

turning the first collet clockwise until the gripping fingers firmly engage the head of the screw;

rotating the second collet clockwise until the screwdriver fitting means firmly engages the head of the screw;

placing the tip of the screw against the material the screw is to be inserted into;

tapping the handle means end, if necessary, to start a hole in the material; and turning the handle means until the screw is seated in the material; and rotating the first and second collet counterclockwise to release the locking screwdriver from the screw.

20. The method of using the locking screwdriver as in claim 19 wherein the locking screwdriver is used for removing a screw by turning the locking screwdriver in a counterclockwise manner after the tool has been attached as described in claim 19.

21. The method of using the locking screwdriver as in claim 20 wherein the material surrounding a sunken screw is removed by placing the cutting tips around the screw head, cutting the material by rotating the locking screwdriver, attaching the locking screwdriver in the above manner and rotating the locking screwdriver in a counterclockwise manner to remove the screw.

* * * * *